US011160392B2

(12) United States Patent
Ewing et al.

(10) Patent No.: US 11,160,392 B2
(45) Date of Patent: Nov. 2, 2021

(54) PRODUCT PUSHER ASSEMBLY

(71) Applicant: Fasteners for Retail, Inc., Twinsburg, OH (US)

(72) Inventors: Brent Ewing, Aurora, OH (US); Michael Eric Liedtke, Kent, OH (US); Shane Obitts, North Ridgeville, OH (US); James Bacnik, Mentor, OH (US); William H. Walker, Fairlawn, OH (US)

(73) Assignee: Fasteners for Retail, Inc., Twinsburg, OH (US)

( * ) Notice: Subject to any disclaimer, the term of this patent is extended or adjusted under 35 U.S.C. 154(b) by 0 days.

(21) Appl. No.: 16/984,784

(22) Filed: Aug. 4, 2020

(65) Prior Publication Data

US 2021/0037991 A1 Feb. 11, 2021

Related U.S. Application Data

(60) Provisional application No. 62/885,006, filed on Aug. 9, 2019.

(51) Int. Cl.
*A47F 1/12* (2006.01)
*A47F 5/00* (2006.01)

(52) U.S. Cl.
CPC ..... *A47F 1/126* (2013.01); *A47F 5/005* (2013.01)

(58) Field of Classification Search
CPC ..... A47F 1/126; A47F 5/0043; A47F 7/024; A47F 5/16; A47F 5/0018; A47F 5/0025; A47F 1/03; A47F 3/14; A47F 1/10; A47F 7/28; A47F 7/0246; A47F 5/0068; A47F 5/005; A47F 1/125; A47F 1/04; A47F 7/17; A47F 1/06; A47F 1/08; A47F 1/12; A47F 3/02; A47B 57/58; A47B 57/585; A47B 57/583; A47B 57/588; G06F 11/06
USPC ..... 211/59.3, 59.2, 184, 119.003; 108/60, 108/61, 71, 6; 312/61, 71; 221/227, 255, 221/279
See application file for complete search history.

(56) References Cited

U.S. PATENT DOCUMENTS 4,300,693 A * 11/1981 Spamer ..... A47F 1/126 211/59.3
6,227,385 B1 * 5/2001 Nickerson ..... A47F 1/126 108/61
6,464,089 B1 10/2002 Rankin, VI
7,918,353 B1 * 4/2011 Luberto ..... A47F 1/126 211/59.3

(Continued)

OTHER PUBLICATIONS

International Search Report and Written Opinion for Application No. PCT/US2020/044925 dated Nov. 11, 2020.

*Primary Examiner* — Jennifer E. Novosad
(74) *Attorney, Agent, or Firm* — Honigman LLP

(57) ABSTRACT

A product pusher assembly includes a rail, a divider, and a pusher. The rail extends in a first direction and includes a first engagement mechanism. The divider extends in a second direction perpendicular to the first direction and is coupled to the rail for translation in the first direction and the second direction. The divider includes a front portion, a rear portion, and a second engagement mechanism disposed between the front portion and the rear portion. The second engagement mechanism is configured to selectively engage the first engagement mechanism during translation in the second direction.

15 Claims, 4 Drawing Sheets

(56) References Cited

U.S. PATENT DOCUMENTS 7,971,735 B2 * 7/2011 Mueller ..... A47F 1/126 211/59.3
8,113,360 B2 * 2/2012 Olson ..... A47F 5/005 211/59.3
8,177,076 B2 * 5/2012 Rataiczak, III ..... A47F 1/126 211/59.3
8,276,766 B2 * 10/2012 Rataiczak, III ..... A47F 5/005 211/59.3
8,317,038 B2 * 11/2012 Luberto ..... A47F 1/126 211/59.3
8,627,965 B2 * 1/2014 Hardy ..... A47F 1/126 211/59.3
8,662,319 B2 * 3/2014 Hardy ..... A47F 1/04 211/59.3
8,662,325 B2 * 3/2014 Davis ..... A47B 57/585 211/151
8,998,005 B2 * 4/2015 Hardy ..... A47B 65/15 211/59.3
9,138,075 B2 * 9/2015 Hardy ..... A47F 7/28
9,173,504 B2 * 11/2015 Hardy ..... A47B 57/585
9,185,999 B2 * 11/2015 Hardy ..... A47F 1/126
9,237,816 B2 1/2016 Hardy
9,259,102 B2 * 2/2016 Hardy ..... A47F 1/12
9,265,362 B2 * 2/2016 Hardy ..... A47F 5/005
9,289,078 B2 * 3/2016 Hardy ..... A47F 7/28
9,320,367 B2 * 4/2016 Chambers ..... A47F 5/005
9,402,485 B2 * 8/2016 Hardy ..... A47F 1/126
9,713,395 B2 * 7/2017 Pichel ..... A47F 1/126
9,770,121 B2 * 9/2017 Walker ..... A47B 57/58
9,782,017 B1 * 10/2017 Luberto ..... A47F 1/125
9,955,802 B2 * 5/2018 Bird ..... A47B 57/58
10,178,909 B2 * 1/2019 Hardy ..... A47F 7/28
10,260,545 B2 * 4/2019 Obitts ..... A47B 57/58
10,667,629 B2 * 6/2020 Szpak ..... A47F 5/0068
2001/0002659 A1 * 6/2001 Bada ..... A47F 5/005 211/59.2
2002/0170866 A1 * 11/2002 Johnson ..... A47F 1/126 211/59.3
2003/0024889 A1 * 2/2003 Dumontet ..... A47F 1/125 211/59.3
2005/0077260 A1 * 4/2005 Mueller ..... A47F 1/126 211/59.3
2005/0139560 A1 * 6/2005 Whiteside ..... A47B 57/586 211/119.003
2006/0186064 A1 * 8/2006 Merit ..... A47F 5/005 211/59.3
2007/0068885 A1 * 3/2007 Busto ..... A47F 1/125 211/59.3
2007/0138114 A1 * 6/2007 Dumontet ..... A47F 1/126 211/59.3
2007/0256992 A1 * 11/2007 Olson ..... A47F 5/005 211/59.3
2008/0017598 A1 1/2008 Rataiczak et al.
2008/0156752 A1 * 7/2008 Bryson ..... A47F 1/126 211/59.3
2010/0089847 A1 4/2010 Rataiczak, III et al.
2011/0094980 A1 * 4/2011 Cousin ..... A47F 5/005 211/59.2
2012/0006773 A1 * 1/2012 Mueller ..... A47F 1/126 211/59.3
2013/0062295 A1 * 3/2013 Bird ..... A47F 1/126 211/59.3
2014/0319088 A1 * 10/2014 Neumann ..... A47F 1/126 211/59.3
2015/0164241 A1 * 6/2015 Nagel ..... A47F 1/125 211/59.3
2016/0296039 A1 10/2016 Bird et al.
2021/0037991 A1 * 2/2021 Ewing ..... A47F 1/126
2021/0137265 A1 * 5/2021 Liedtke ..... A47F 5/005

* cited by examiner

PRODUCT PUSHER ASSEMBLY

CROSS REFERENCE TO RELATED APPLICATIONS

This U.S. patent application claims priority under 35 U.S.C. § 119(e) to U.S. Provisional Application 62/885,006 filed on Aug. 9, 2019, the disclosure of which is considered part of the disclosure of this application and is hereby incorporated by reference in its entirety.

FIELD

The present disclosure relates generally to product shelf displays.

BACKGROUND

This section provides background information related to the present disclosure which is not necessarily prior art.

Products in a commercial setting, such as a store, may be displayed in a variety of ways. For example, a series of shelving units may be used to stock and display the products. The products may be arranged in columns and rows, with products of the same type arranged in a column behind one another and products of different types arranged in a row next to each other. When the first product in a column is selected and removed from the shelf, the second product in the column may be moved to the first product's position to occupy the void left by the removal of the first product.

SUMMARY

This section provides a general summary of the disclosure, and is not a comprehensive disclosure of its full scope or all of its features.

One aspect of the disclosure provides a product pusher assembly including a rail, a divider, and a pusher. The rail extends in a first direction and includes a first engagement mechanism. The divider extends in a second direction perpendicular to the first direction and is coupled to the rail for translation in the first direction and the second direction. The divider includes a front portion, a rear portion, and a second engagement mechanism disposed between the front portion and the rear portion. The second engagement mechanism is configured to selectively engage the first engagement mechanism during translation in the second direction.

Implementations of the disclosure may include one or more of the following optional features. In some implementations, the divider includes a slot configured to receive at least a portion of the rail, the slot being disposed between the front portion and the rear portion.

In some implementations, the divider includes a biasing member that biases the first engagement mechanism into engagement with the second engagement mechanism. The biasing member may be a flexible tab engaging a portion of the rail.

In some implementations, the rail includes a front wall, a rear wall, and a base portion connecting the front wall to the rear wall, the front wall including a front surface and the rear wall including a rear surface. The divider may include a slot configured to receive the front wall and a second slot configured to receive the rear wall. The first engagement mechanism may be disposed on the front surface of the front wall. The divider may include a biasing member that biases the first engagement mechanism into engagement with the second engagement mechanism, the biasing member engaging the rear surface of the rear wall.

In some implementations, the divider is translatable along the rail in the first direction when the first engagement mechanism is disengaged with the second engagement mechanism.

In some implementations, the divider is prohibited from translating along the rail in the first direction when the first engagement mechanism is engaged with the second engagement mechanism.

In some implementations, the rail is disposed entirely between the front portion and the rear portion.

Another aspect of the disclosure provides a product pusher assembly including a rail, a divider, and a pusher. The rail extends in a first direction and including a first engagement mechanism. The rail extends from a front surface to a rear surface in a second direction perpendicular to the first direction. The divider extends in the second direction from a front portion to a rear portion and includes a second engagement mechanism configured to selectively engage the first engagement mechanism. The divider is coupled to the rail with both the front surface and the rear surface of the rail being disposed between the front portion and the rear portion of the divider. The pusher extends in the second direction from a second front portion to a second rear portion and coupled to the rail with both the front surface and the rear surface of the rail being disposed between the second front portion and the second rear portion of the pusher.

In some implementations, the divider includes a slot configured to receive at least a portion of the rail, the slot being disposed between the front portion and the rear portion.

In some implementations, the divider includes a biasing member that biases the first engagement mechanism into engagement with the second engagement mechanism.

In some implementations, the rail includes a front wall, a rear wall, and a base portion connecting the front wall to the rear wall, the front wall including the front surface and the rear wall including the rear surface. The divider may include a biasing member that biases the first engagement mechanism into engagement with the second engagement mechanism, the biasing member engaging the rear surface of the rear wall.

In some implementations, the pusher includes a base and a wall slidably attached to the base, the wall being slidable along the base in the second direction. The base may be slidably attached to the rail, the base being slidable along the rail in the first direction.

In some implementations, the rail is disposed entirely between the front portion and the rear portion.

Another aspect of the disclosure provides a product pusher assembly including a divider and a rail. The divider extends in a first direction and including a front portion, a rear portion, and a first engagement mechanism disposed between the front portion and the rear portion. The rail is coupled to the divider and disposed entirely between the front portion and the rear portion. The rail extends in a second direction perpendicular to the first direction and includes a second engagement mechanism configured to selectively engage the first engagement mechanism.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Figure 1:
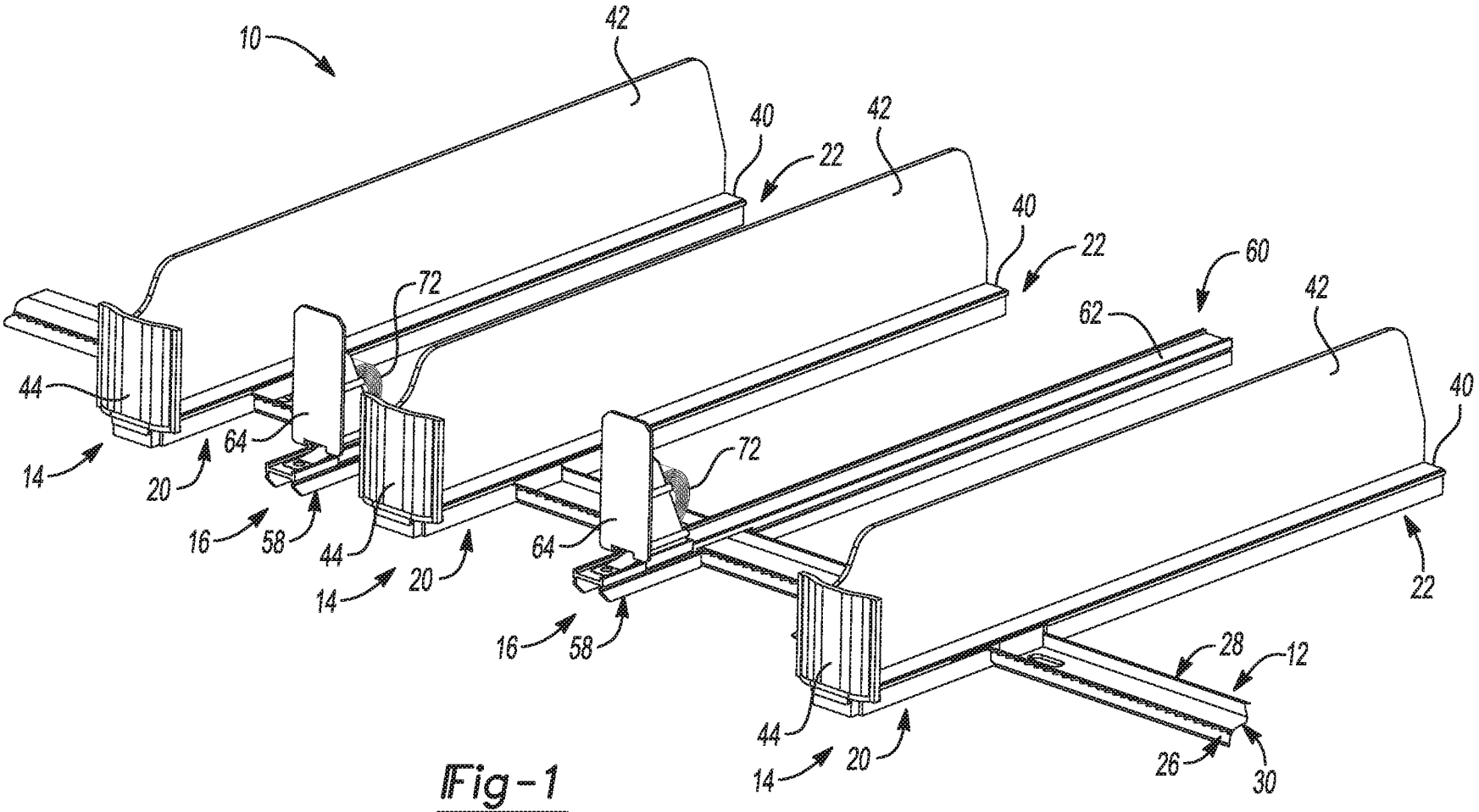
FIG. 1 is a perspective view of a product pusher assembly in accordance with the principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

Figure 2:
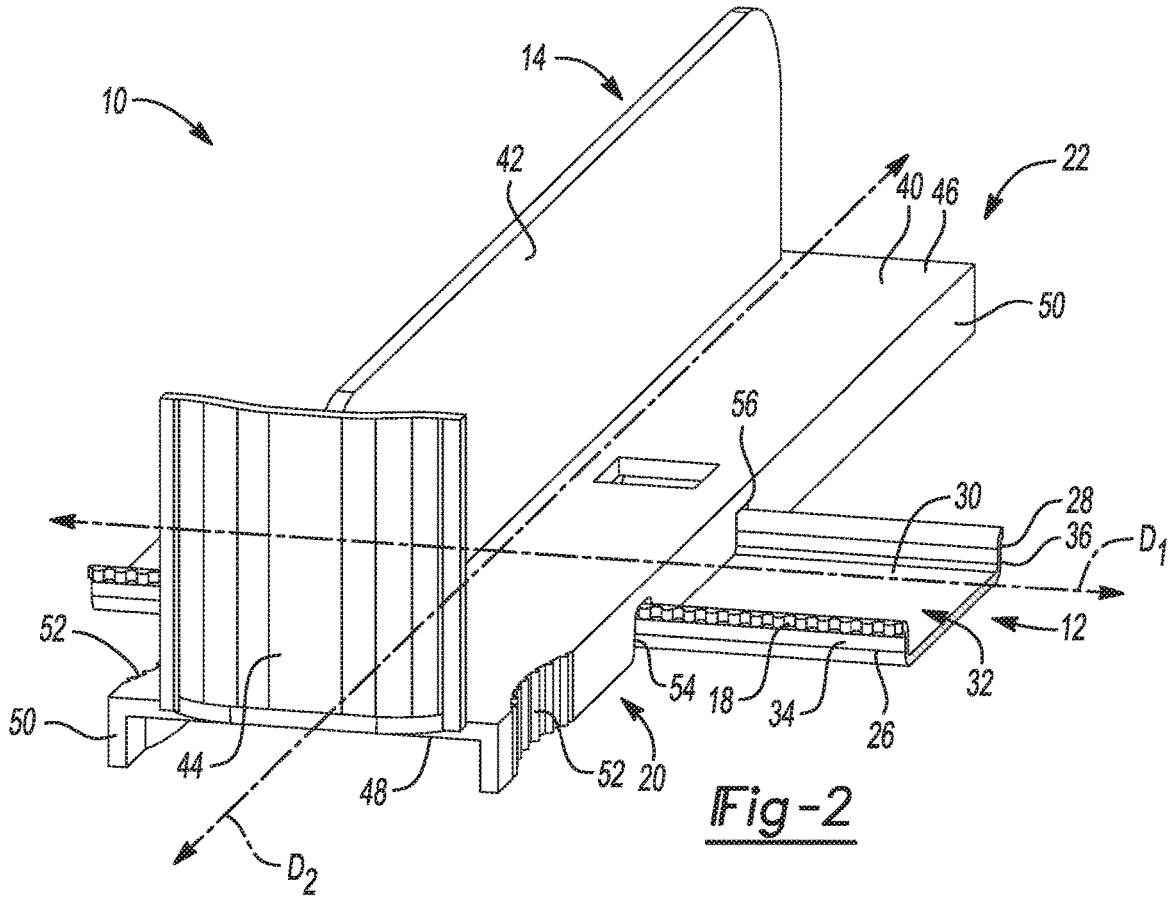
FIG. 2 is a top perspective view of a portion of the product pusher assembly of FIG. 1, including a rail and a divider.

Referring to FIGS. 1 and 2, a product pusher assembly 10 is generally shown. The product pusher assembly 10 may be disposed on a shelf (not shown) or other suitable supporting device, and may include a rail 12, a divider 14, and a pusher 16. The rail 12 extends in a first direction $D_1$ and includes a first engagement mechanism 18. The divider 14 extends in a second direction $D_2$ perpendicular to the first direction $D_1$ and is coupled to the rail 12 for translation in the first direction $D_1$ and the second direction $D_2$. The divider 14 includes a front portion 20, a rear portion 22, and a second engagement mechanism 24 disposed between the front portion 20 and the rear portion 22. The second engagement mechanism 24 is configured to selectively engage the first engagement mechanism 18 during translation in the second direction $D_2$.

Figure 3:
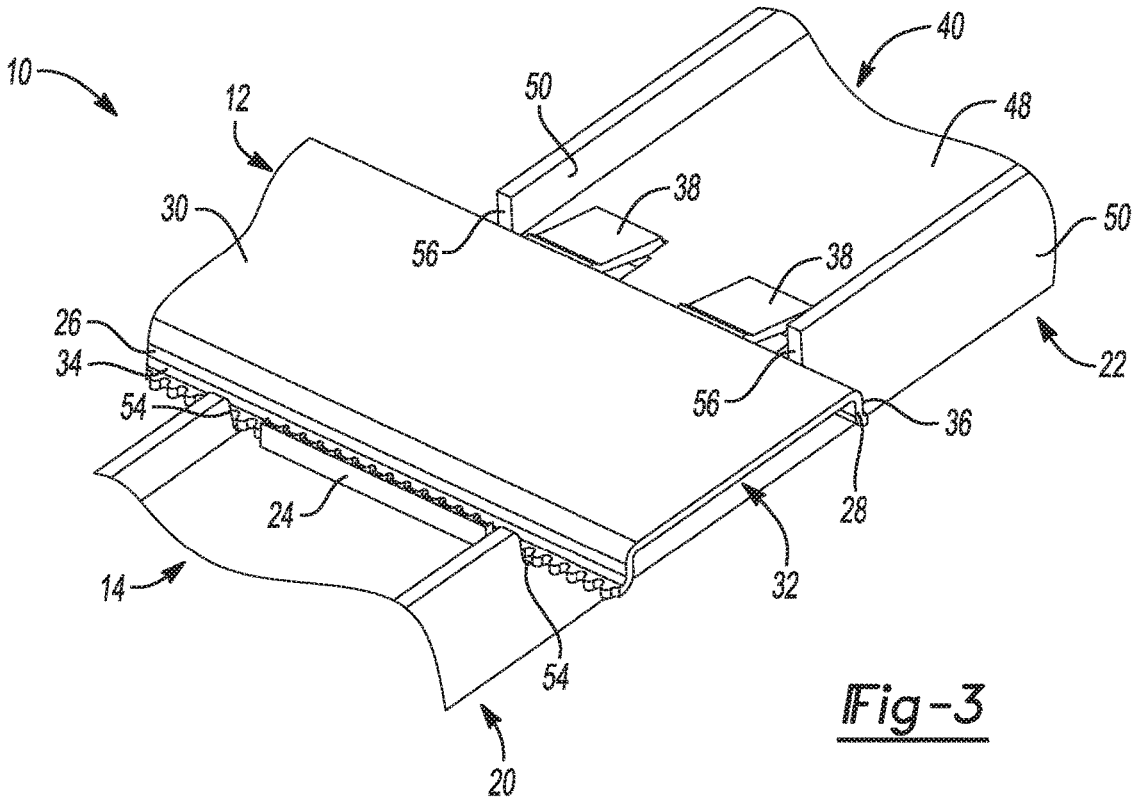
FIG. 3 is a perspective view of an underside of the rail and the divider of FIG. 2.

Referring to FIGS. 1-3, by having the second engagement mechanism 24 disposed between the front portion 20 and the rear portion 22, the divider 14 is translatable along the rail 12 in the first direction $D_1$ with the rail 12 being disposed between the front portion 20 and the rear portion 22. Such a configuration may reduce localized stress on the divider 14 compared to when the rail 12 is disposed closer to or past one of the front portion 20 or the rear portion 22. Moreover, by positioning the rail 12 between the front portion 20 and the rear portion 22, the divider 14 may translate along the rail 12 in the first direction $D_1$ more efficiently and effectively.

Referring to FIGS. 1 and 2, the rail 12 may be configured to be placed on a shelf (not shown) or other suitable surface of a store. For example, the rail 12 may include a generally flat bottom surface. In some implementations, the rail 12 may include feet or gripping members to reduce friction between the rail and the shelf. In other implementations, the rail 12 may be secured to the shelf in any suitable manner, such as, for example, mechanical fasteners, adhesive, welding, etc. While the product pusher assembly 10 is shown in FIG. 1 as including one rail 12, three dividers 14, and two pushers 16, it should be understood that any suitable number of these components may be implemented.

The rail 12 extends in the first direction $D_1$ and the divider 14 extends in the second direction $D_2$. It should be understood that the first direction $D_1$ and the second direction $D_2$ are each described as including directions 180 degrees relative to the first direction $D_1$ and the second direction $D_2$, respectively. For example, the divider 14 being translatable along the rail 12 in the first direction $D_1$ should be understood to mean that, with respect to the orientation shown in FIG. 2, the divider 14 may translate generally to the right and generally to the left along the rail 12, and the divider 14 being translatable along the rail 12 in the second direction $D_2$ should be understood to mean that, with respect to the orientation shown in FIG. 2, the divider 14 may translate generally inward and outward along the rail 12.

The rail 12 may have a generally U-shaped cross-section and the rail 12 includes a front wall 26, a rear wall 28, and a base portion 30 connecting the front wall 26 to the rear wall 28. The front wall 26, the rear wall 28, and the base portion 30 cooperate to define a channel 32 configured to receive a portion of the divider 14. The front wall 26 includes a front surface 34 and the rear wall includes a rear surface 36. The front wall 26 may include the first engagement mechanism 18. For example, the first engagement mechanism 18 may be attached to or integrally formed with the front wall 26 at the front surface 34 or any other suitable location on the rail 12. In some implementations, the first engagement mechanism 18 is a plurality of teeth extending along the front surface 34 of the front wall 26 in the first direction $D_1$. In other implementations, the first engagement mechanism 18 may be any suitable engagement mechanism, such as, for example, a mechanical fastener, a magnet, an electromagnet, a hook-and-loop fastener, etc. In some implementations, the rear surface 36 of the rear wall may include any suitable feature(s) to receive biasing members 38 of the divider 14.

Referring to FIGS. 1-5, the divider 14 extends from the front portion 20 to the rear portion 22. As used herein, the term "front" generally refers to the portion of the divider 14 that would be facing prospective customers or an aisle in a store and the term "rear" generally refers to the portion of the divider 14 that is furthest from prospective customers or an aisle in a store. For example, as shown in FIG. 2, the rail 12 is disposed entirely between the front portion 20 and the rear portion 22 of the divider 14. While the rail 12 is shown as being disposed closer to the front portion 20 than the rear portion 22, in some implementations, the rail 12 may be disposed closer to the rear portion 22 than the front portion 20 or disposed equidistant from the front portion 20 and the rear portion 22.

Figure 4:
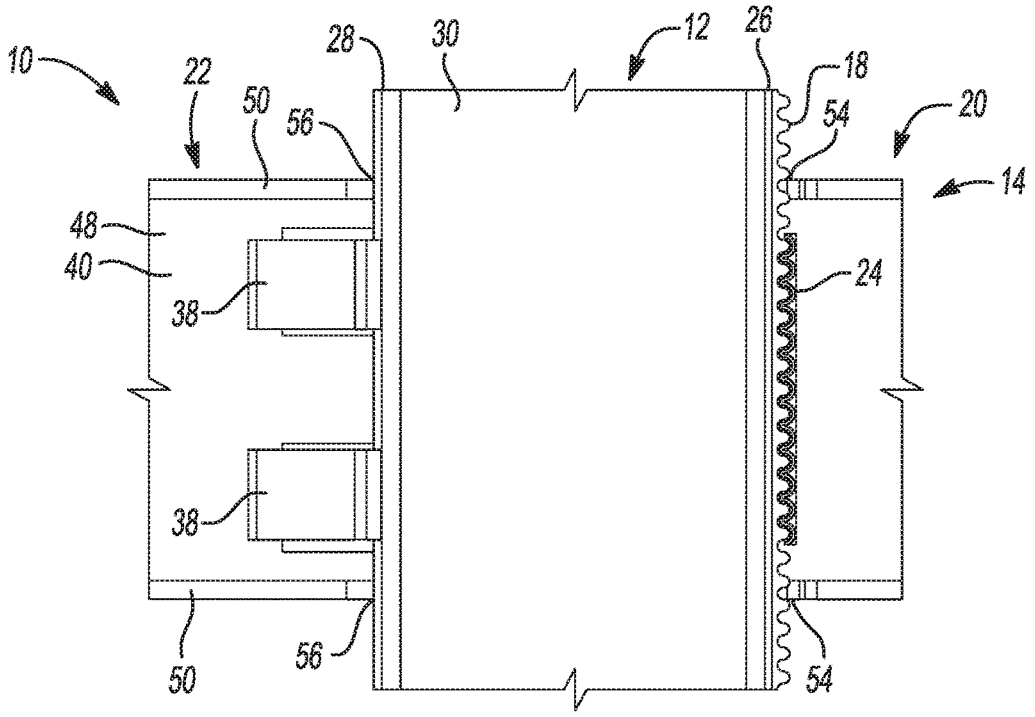
FIG. 4 is a bottom plan view of the rail and the divider of FIG. 2.
Figure 5:
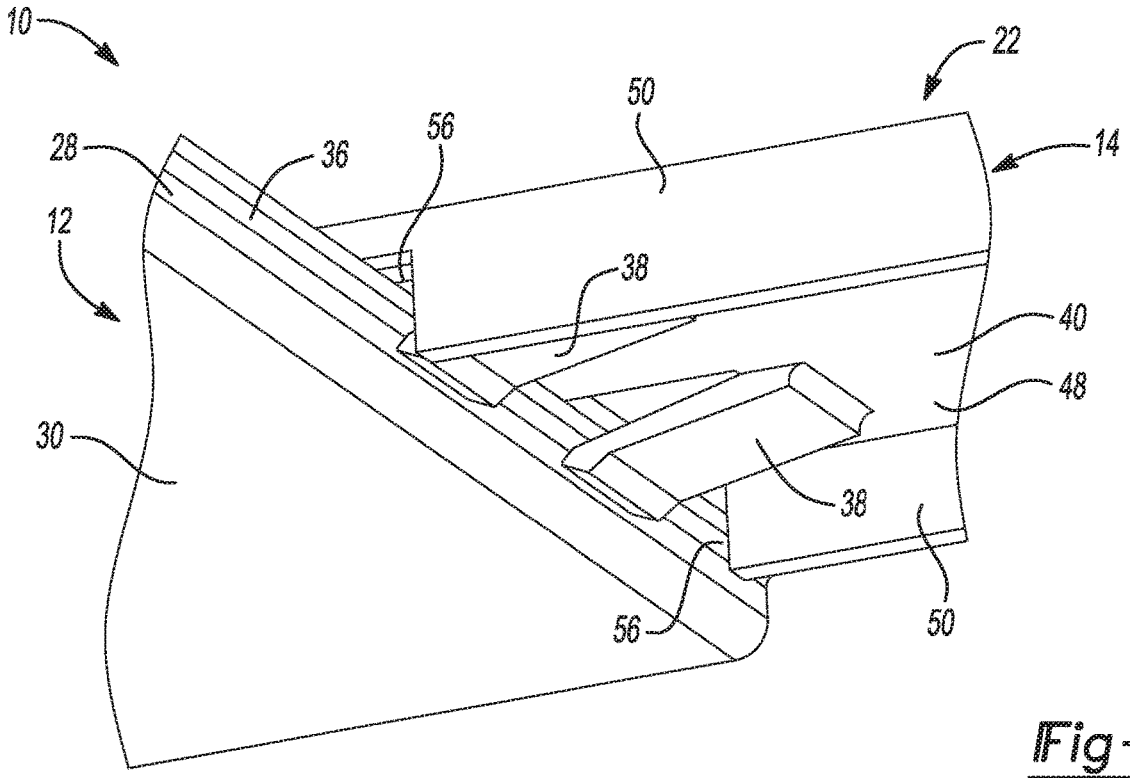
FIG. 5 is a perspective view of the underside of the rail and the divider of FIG. 2.

The divider 14 includes a base 40, a dividing wall 42, and a stopper 44. The base 40 and the dividing wall 42 generally extend from the front portion 20 to the rear portion 22, while the stopper 44 is disposed at or near the front portion 20 to cooperate with the pusher 16 to hold products in place. The base 40 includes a top surface 46 configured to receive products, a bottom surface 48 opposite the top surface 46, and a pair of side walls 50 extending from the bottom surface 48. Referring to FIGS. 3-5, the bottom surface 48 may include the second engagement mechanism 24 disposed at or near the front portion 20 of the divider 14. In other implementations, the second engagement mechanism 24 is disposed at any suitable location on the divider 14. As shown, the second engagement mechanism 24 may be a plurality of teeth configured to selectively engage the first engagement mechanism 18, which may be a plurality of corresponding teeth. In other implementations, the second engagement mechanism 24 may be any suitable engagement mechanism, such as, for example, a mechanical fastener, a magnet, an electromagnet, a hook-and-loop fastener, etc.

With continued reference to FIGS. 3-5, the bottom surface 48 may include the biasing members 38. There may be two biasing members 38 as shown or there may be any suitable number of biasing members 38. In some implementations, the biasing members 38 are flexible tabs that engage the rear surface 36 of the rear wall 28 of the rail 12. In these implementations, the biasing members 38 are configured to flex toward and away from the bottom surface 48. For example, the biasing members 38 bias the first engagement mechanism 18 into engagement with the second engagement mechanism 24 to prohibit the divider 14 from sliding or translating along the rail 12 in the first direction $D_1$. Conversely, when a sufficient force is exerted in the second direction $D_2$ towards the rear portion 22, the biasing members 38 flex to allow the first engagement mechanism 18 to disengage with the second engagement mechanism 24 such that the divider may slide or translate along the rail 12 in the first direction $D_1$. In other implementations, the biasing members 38 may be any suitable biasing member, such as, for example, springs, compressible structures, etc.

Referring to FIG. 2, the divider 14 may include a pair of gripping members 52 disposed on the side walls 50 and/or the base 40 at or near the front portion 20. The gripping members 52 may be a plurality of ridges, a high-friction material, or any other suitable gripping member 52. The gripping members 52 may facilitate pushing and pulling of the divider 14 along the second direction $D_2$.

The divider 14 may include a front slot 54 and a rear slot 56 configured to receive the rail 12. In other implementations, the front slot 54 and the rear slot 56 may be merged into a singular slot. The front slot 54 is configured to receive the front wall 26 of the rail 12, the rear slot 56 is configured to receive the rear wall 28 of the rail 12, and a portion of each of the side walls 50 are disposed in the channel 32 of the rail from at or near the front wall 26 to at or near the rear wall 28. The front slot 54 and the rear slot 56 may be sized to allow the divider 14 to translate along the rail 12 in the second direction $D_2$, such that the first engagement mechanism 18 and the second engagement mechanism 24 may move between an engaged position and a disengaged position. The front slot 54 and the rear slot 56 are disposed entirely between the front portion 20 and the rear portion 22 of the divider 14 to receive the rail 12 entirely between the front portion 20 and the rear portion 22. In other implementations, the divider 14 may be coupled to the rail 12 in any suitable manner.

Figure 7:
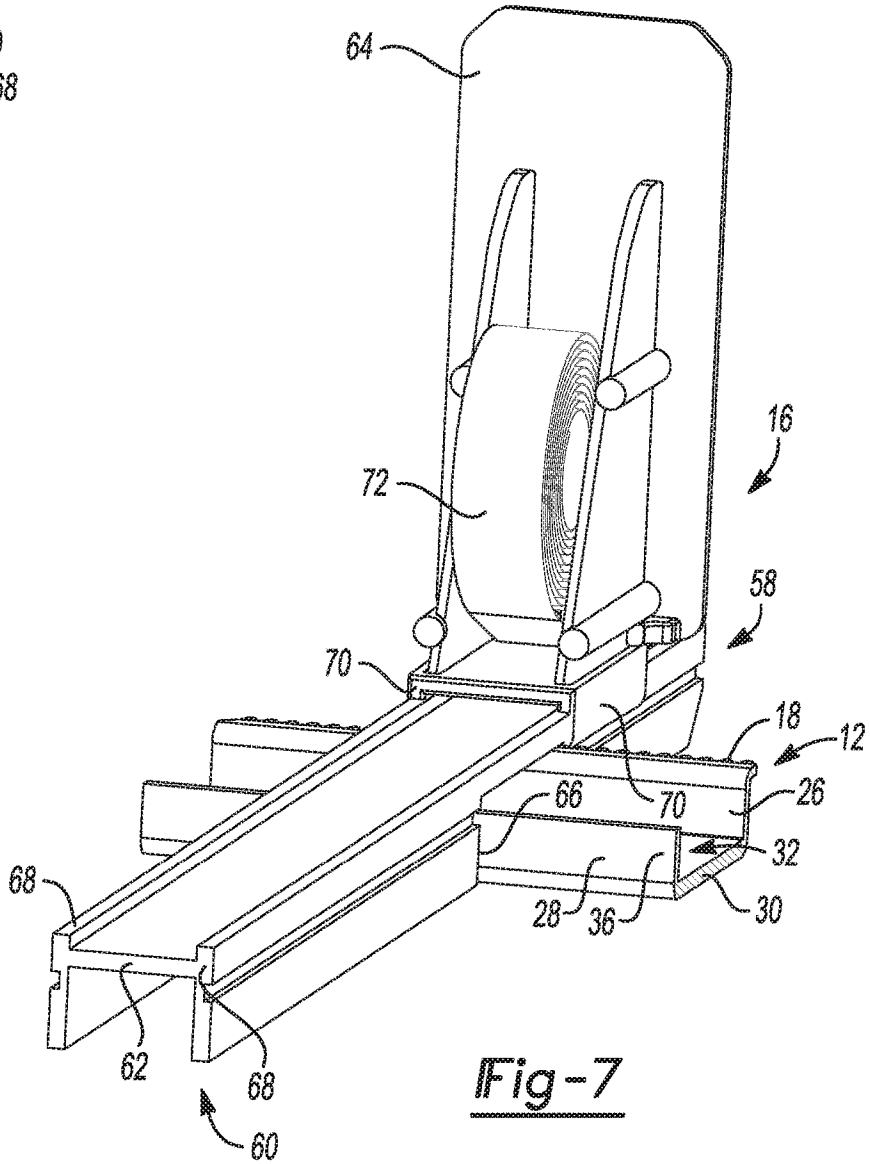
FIG. 7 is a rear perspective view of the rail and the pusher of FIG. 6.
Figure 6:
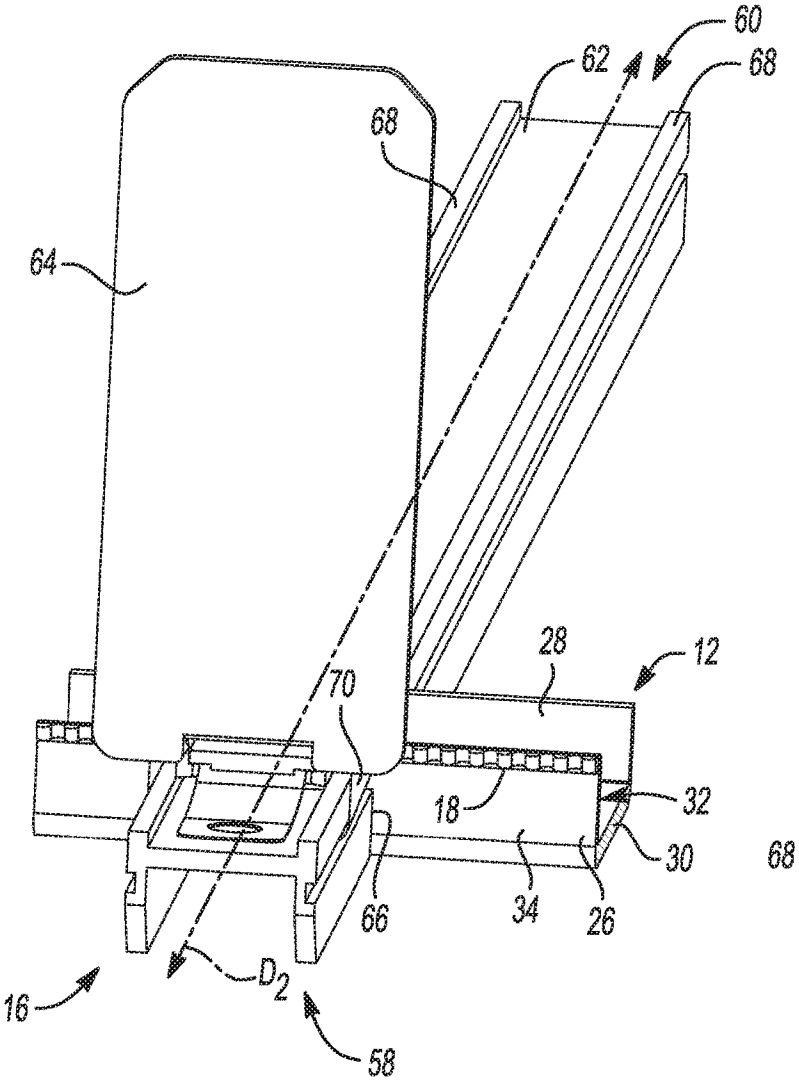
FIG. 6 is a front perspective view of a portion of the product pusher assembly of FIG. 1, including the rail and a pusher.

Referring to FIGS. 1, 6, and 7, the pusher 16 extends in the second direction $D_2$ from a front portion 58 to a rear portion 60. The pusher 16 is coupled to the rail 12 being entirely disposed between the front portion 58 and the rear portion 60. That is, both the front surface 34 and the rear surface 36 of the rail 12 are disposed between the front portion 58 and the rear portion 60. The pusher 16 may be translatable along the rail 12 in the first direction $D_1$. In some implementations, the pusher 16 includes a third engagement mechanism (not shown) similar to the second engagement mechanism 24 of the divider 14, such that the pusher 16 may be selectively translatable along the rail 12. In other implementations, the pusher 16 may slide or translate freely along the rail 12 with no engagement mechanism. In yet other implementations, the pusher 16 may include a detent, friction material, or any other suitable mechanism for controlling translation along the rail 12.

The pusher 16 includes a base 62 and a wall 64 slidably attached to the base 62 in the second direction $D_2$. The base 62 may be slidably attached to the rail 12, such that the base 62 is slidable or translatable along the rail 12 in the first direction $D_1$. To slide or translate along the rail 12, the base 62 may include one or more slots 66 that receive the rail 12, e.g., the front wall 26 and the rear wall 28 of the rail 12. The base 62 may include tracks 68 on a top surface and the wall 64 may include slides 70 configured to engage the tracks 68, such that the wall 64 is slidable or translatable along the base 62 in the second direction $D_2$. In other implementations, the wall 64 may be slidable or translatable along the base 62 in any suitable manner. The pusher 16 may include a biasing member 72 biasing the wall 64 toward the front portion 58 to retain product between the wall 64 and the stopper 44 of the divider 14. When a product in a column is removed, the biasing member 72 urges the wall 64 toward the front portion until the column of products extends from the wall 64 to the stopper 44.

The components of the product pusher assembly 10, i.e., the rail 12, the divider 14, and the pusher 16, may be formed of any suitable material(s). These components may be formed of the same material, different materials, or some combination of the two. For example, these components may be formed of a plastic, a metal, carbon fiber, etc. These components may be formed by or implementing any suitable process, such as, for example, injection molding, 3-D printing, welding, gluing, mechanical fastening, etc.

As set forth above, the product pusher assembly 10 may be implemented on a shelf or other suitable surface of a store or any suitable storage location. The divider 14, for example, two dividers 14, and the pusher 16 may be translated along the rail 12 to allow products to be inserted into the product pusher assembly 10. For example, wide products may require the dividers 14 to be translated along the rail 12 in the first direction $D_1$ away from each other, and narrow products may require the dividers 14 to be translated along the rail 12 in the first direction $D_1$ toward each other. To translate the divider 14, a user may grasp the divider 14, for example at the gripping members 52, and push the divider 14 rearward along the second direction $D_2$ to overcome the biasing of the biasing members 38 and disengage the first engagement mechanism 18 and the second engagement mechanism 24. At this point, the divider 14 may slide or translate along the rail 12 in the first direction $D_1$ to a desired position. At the desired position, the user may pull the divider 14, let go of the divider 14, or otherwise remove the force resulting from pushing the divider 14, thus causing the biasing members 38 to press against the rear wall 28 of the rail 12 until the first engagement mechanism 18 engages again with the second engagement mechanism 24. At this point, the divider 14 is prohibited from translating along the rail 12 in the first direction $D_1$.

A column of products may be inserted between the wall 64 and the stopper 44 with the biasing member 72 of the pusher 16 sandwiching the products between the wall 64 and the stopper 44. The positioning of generally rectangular products may be maintained between the wall 64, the stopper 44, and two opposing dividing walls 42 of two opposing dividers 14. When a product in the column is removed, the biasing member 72 biases the wall 64 toward the front portion 58 of the pusher 16, filling the void left by the removed product and shifting the column of products forward until the column of products extends from the wall 64 to the stopper 44.

The following Clauses provide an exemplary configuration for a product pusher assembly, as described above.

Clause 1: A product pusher assembly comprising: a rail extending in a first direction and including a first engagement mechanism; and a divider extending in a second direction perpendicular to the first direction and coupled to the rail for translation in the first direction and the second direction, the divider including a front portion, a rear portion, and a second engagement mechanism disposed between the front portion and the rear portion, the second engagement mechanism configured to selectively engage the first engagement mechanism during translation in the second direction.

Clause 2: The product pusher assembly of Clause 1, wherein the divider includes a slot configured to receive at least a portion of the rail, the slot being disposed between the front portion and the rear portion.

Clause 3: The product pusher assembly of Clause 1 or Clause 2, wherein the divider includes a biasing member that biases the first engagement mechanism into engagement with the second engagement mechanism.

Clause 4: The product pusher assembly of Clause 3, wherein the biasing member is a flexible tab engaging a portion of the rail.

Clause 5: The product pusher assembly of any one of Clauses 1-4, wherein the rail includes a front wall, a rear wall, and a base portion connecting the front wall to the rear wall, the front wall including a front surface and the rear wall including a rear surface.

Clause 6: The product pusher assembly of Clause 5, wherein the divider includes a slot configured to receive the front wall and a second slot configured to receive the rear wall.

Clause 7: The product pusher assembly of Clause 5 or Clause 6, wherein the first engagement mechanism is disposed on the front surface of the front wall.

Clause 8: The product pusher assembly of any one of Clauses 5-7, wherein the divider includes a biasing member that biases the first engagement mechanism into engagement with the second engagement mechanism, the biasing member engaging the rear surface of the rear wall.

Clause 9: The product pusher assembly of any one of Clauses 1-8, wherein the divider is translatable along the rail in the first direction when the first engagement mechanism is disengaged with the second engagement mechanism.

Clause 10: The product pusher assembly of any one of Clauses 1-9, wherein the divider is prohibited from translating along the rail in the first direction when the first engagement mechanism is engaged with the second engagement mechanism.

Clause 11: The product pusher assembly of any one of Clauses 1-10, wherein the rail is disposed entirely between the front portion and the rear portion.

Clause 12: A product pusher assembly comprising: a rail extending in a first direction and including a first engagement mechanism, the rail extending from a front surface to a rear surface in a second direction perpendicular to the first direction; a divider extending in the second direction from a front portion to a rear portion and including a second engagement mechanism configured to selectively engage the first engagement mechanism, the divider coupled to the rail with both the front surface and the rear surface of the rail being disposed between the front portion and the rear portion of the divider; and a pusher extending in the second direction from a second front portion to a second rear portion and coupled to the rail with both the front surface and the rear surface of the rail being disposed between the second front portion and the second rear portion of the pusher.

Clause 13: The product pusher assembly of Clause 12, wherein the divider includes a slot configured to receive at least a portion of the rail, the slot being disposed between the front portion and the rear portion.

Clause 14: The product pusher assembly of Clause 12 or Clause 13, wherein the divider includes a biasing member that biases the first engagement mechanism into engagement with the second engagement mechanism.

Clause 15: The product pusher assembly of any one of Clauses 12-14, wherein the rail includes a front wall, a rear wall, and a base portion connecting the front wall to the rear wall, the front wall including the front surface and the rear wall including the rear surface.

Clause 16: The product pusher assembly of Clause 15, wherein the divider includes a biasing member that biases the first engagement mechanism into engagement with the second engagement mechanism, the biasing member engaging the rear surface of the rear wall.

Clause 17: The product pusher assembly of any one of Clauses 12-16, wherein the pusher includes a base and a wall slidably attached to the base, the wall being slidable along the base in the second direction.

Clause 18: The product pusher assembly of Clause 17, wherein the base is slidably attached to the rail, the base being slidable along the rail in the first direction.

Clause 19: The product pusher assembly of any one of Clauses 12-18, wherein the rail is disposed entirely between the front portion and the rear portion.

Clause 20: A product pusher assembly comprising: a divider extending in a first direction and including a front portion, a rear portion, and a first engagement mechanism disposed between the front portion and the rear portion; and a rail coupled to the divider and disposed entirely between the front portion and the rear portion, the rail extending in a second direction perpendicular to the first direction and including a second engagement mechanism configured to selectively engage the first engagement mechanism.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A product pusher assembly comprising:

a rail including a front wall, a rear wall, and a first engagement mechanism including a plurality of teeth extending along the front wall;

a divider slidably coupled to the rail and defining a front product-receiving portion extending a first direction from the front wall of the rail and a rear product-receiving portion extending an opposite second direction from the rear wall of the rail, the divider having a pair of side walls each (i) defining a first slot configured to receive the front wall of the rail and (ii) including a second engagement mechanism disposed within the first slot and configured to selectively engage the at least one of the teeth of the first engagement mechanism; and a pusher wall coupled to the rail adjacent to the divider and operable to move parallel to the divider.

2. The product pusher assembly of claim 1, wherein the first slot is disposed between the front product-receiving portion and the rear product-receiving portion.

3. The product pusher assembly of claim 1, wherein the divider includes a biasing member that biases the first engagement mechanism into engagement with the second engagement mechanism.

4. The product pusher assembly of claim 1, wherein the rail includes a base portion connecting the front wall to the rear wall, the front wall including a front surface and the rear wall including a rear surface.

5. The product pusher assembly of claim 4, wherein the divider includes a base having a top surface, a bottom surface opposite the top surface, and the pair of side walls extending from the bottom surface, each of the side walls includes a second slot configured to receive the rear wall.

6. The product pusher assembly of claim 5, wherein the divider includes a biasing member extending from the bottom surface that engages the rear surface of the rear wall to bias the first engagement mechanism into engagement with the second engagement mechanism.

7. The product pusher assembly of claim 4, wherein the first engagement mechanism is disposed on the front surface of the front wall.

8. The product pusher assembly of claim 1, wherein the divider is translatable along the rail when the first engagement mechanism is disengaged from the second engagement mechanism.

9. The product pusher assembly of claim 8, wherein the divider is prohibited from translating along the rail when the at least one of the teeth of the first engagement mechanism is engaged with the second engagement mechanism.

10. The product pusher assembly of claim 1, wherein the rail is disposed between the front product-receiving portion and the rear product-receiving portion.

11. The product pusher assembly of claim 10, wherein the divider includes a base slidably attached to the rail, the base being slidable along the rail in the first direction.

12. A product pusher assembly comprising:

a rail extending in a first direction and including a first engagement mechanism, the rail extending from a front surface to a rear surface in a second direction perpendicular to the first direction;

a divider extending along the second direction from a first end to a second end and including (i) a base having a top surface and a bottom surface disposed on an opposite side from the top surface, (ii) a pair of side walls extending from the bottom surface of the base and each receiving the rail, (iii) a second engagement mechanism disposed on at least one of the side walls and configured to selectively engage the first engagement mechanism, and (iv) at least one flexible tab extending from the bottom surface of the base and engaging the rear surface of the rail to bias the first engagement mechanism of the rail into engagement with the second engagement mechanism of the divider; and a pusher coupled to the rail adjacent to the divider and including a wall operable to move along the first direction.

13. The product pusher assembly of claim 12, wherein each sidewall of the divider includes a slot configured to receive at least a portion of the rail, the slot being disposed between the first end and the second end.

14. The product pusher assembly of claim 12, wherein the rail includes a front wall, a rear wall, and a base portion connecting the front wall to the rear wall, the front wall including the front surface and the rear wall including the rear surface.

15. The product pusher assembly of claim 12, wherein the rail is disposed between the first end and the second end.

* * * * *